US006391942B1

(12) United States Patent
Chang et al.

(10) Patent No.: US 6,391,942 B1
(45) Date of Patent: May 21, 2002

(54) FURAN NO-BAKE FOUNDRY BINDERS AND THEIR USE

(75) Inventors: Ken K. Chang; David A. Hutchings, both of Dublin, OH (US)

(73) Assignee: Ashland Inc., Dublin, OH (US)

( * ) Notice: Subject to any disclaimer, the term of this patent is extended or adjusted under 35 U.S.C. 154(b) by 0 days.

(21) Appl. No.: 09/559,766

(22) Filed: Apr. 27, 2000

(51) Int. Cl.[7] ..... B22C 1/22
(52) U.S. Cl. ..... 523/144; 523/147; 523/148
(58) Field of Search ..... 523/144, 147, 523/145, 146, 148

(56) References Cited

U.S. PATENT DOCUMENTS 4,215,206 A * 7/1980 Hanesworth et al. ..... 525/441
4,334,344 A * 6/1982 Alicot et al. ..... 548/158
4,371,648 A * 2/1983 Gardikes et al. ..... 523/144
4,543,374 A * 9/1985 Menting ..... 523/144
4,644,022 A * 2/1987 Iyer ..... 523/144
4,761,441 A * 8/1988 Woodson ..... 523/439
4,946,876 A * 8/1990 Carpenter et al. ..... 523/143
4,982,781 A * 1/1991 Carpenter et al. ..... 164/526
5,607,986 A * 3/1997 Kim et al. ..... 523/141
5,612,392 A * 3/1997 Chang et al. ..... 523/144
5,856,375 A * 1/1999 Chang et al. ..... 523/145

FOREIGN PATENT DOCUMENTS

JP 60-92037 * 5/1985

* cited by examiner

*Primary Examiner*—Edward J. Cain
*Assistant Examiner*—Katarzyna W. Lee
(74) *Attorney, Agent, or Firm*—David L. Hedden

(57) ABSTRACT

This invention relates to furan no-bake foundry binders comprising (a) a reactive furan resin, (b) furfuryl alcohol, and (c) a catalyst component comprising a catalytically effective amount of a Lewis acid furan catalyst. The invention also relates to foundry mixes prepared with the binder, foundry shapes prepared with the foundry mix, and metal castings prepared with the foundry shapes.

22 Claims, No Drawings

FURAN NO-BAKE FOUNDRY BINDERS AND THEIR USE

FIELD OF THE INVENTION

This invention relates to furan no-bake foundry binders comprising (a) a reactive furan resin, (b) furfuryl alcohol, and (c) a catalyst component comprising a catalytically effective amount of a Lewis acid furan catalyst. The invention also relates to foundry mixes prepared with the binder, foundry shapes prepared with the foundry mix, and metal castings prepared with the foundry shapes.

BACKGROUND OF THE INVENTION

One of the most commercially successful no-bake binders is the phenolic-urethane no-bake binder. This binder provides molds and cores with excellent strengths that are produced in a highly productive manner. Although this binder produces good cores and molds at a high speed, there is an interest in binders that have less volatile organic compounds (VOC), free phenol level, free formaldehyde, and that produce less odor and smoke during core making and castings. Furan binders have these advantages, but their cure speed is much slower than the cure speed of phenolic urethane no-bake binders. Furan binders have been modified to increase their reactivity, for instance by incorporating with urea-formaldehyde resins, phenol-formaldehyde resins, novolac resins, phenolic resole resins, and resorcinol into the binder. Nevertheless, these modified furan binders system do not provide the cure speed needed in foundries that require high productivity.

U.S. Pat. No. 5,856,375 discloses the use of BPA tar in furan no-bake binders to increase the cure speed of the furan binder. Although the cure speed of the binder is increased by the addition of the BPA tar, the tensile strength of this system does not match that of the phenolic urethane system.

Cure speed is not the only consideration in selecting a binder. Cores and molds made with the binder can have unacceptable properties that result in casting defects such as veining, penetration, and surface finish, when the cores and molds are used to make metal castings. Veining is an expansion defect that results when a mold or cores cracks under thermal stress before the casting solidifies. As a result, molten metal enters the cracks of the mold or core and a casting with "veins" or "fins" results. These veins or fins must be removed by machining for the casting to be useful. Mechanical penetration occurs when the pressure of molten metal is high enough to force it into the interstices of a mold or core surface. The result is an integral mixture of sand and metal that is quite difficult to remove in grinding room operations.

SUMMARY OF THE INVENTION

This invention relates to furan no-bake binders comprising:

(a) a reactive furan resin, (b) furfuryl alcohol, (c) a catalyst component comprising a catalytically effective amount of a catalyst comprising a Lewis acid.

Preferably the reactive furan resin is mixture of a conventional furan and a furan derived from the homopolymerization of binder bis-hydroxymethylfuran. Preferably, the catalyst is a mixture of a Lewis acid and a conventional furan catalyst. Preferably, the binder also contains an activator selected from the group consisting of resorcinol, resorcinol pitch, and bisphenol A tar; a bisphenol compound; a polyol; and a silane.

The binders display several advantages when compared to a conventional furan no-bake binder. Cores prepared with the binders cure much faster than those prepared with conventional furan no-bake binders. In fact, the cure speed of cores prepared by the binders of this invention is comparable to that of the phenolic urethane no-bake binder, which is used commercially to make cores where high-speed production is needed. The cure speed of cores prepared from this invention is much faster than those prepared by the conventional furan no-bake binder that do not use a Lewis acid as the catalyst or co-catalyst.

Additionally, the cores made with the binder display excellent tensile strength and excellent casting results. The cores and molds produced by this invention exhibited greater resistance to veining than those produced with furan binders that were not cured with the Lewis acid catalyst. They also exhibited better resistance to veining than cores and molds prepared with phenolic-urethane no-bake binders. The cores and molds are produced in a highly productive manner and have good core handling strength. The binders are advantageous from an environmental standpoint because they contain low VOC, low odor, zero phenol, zero solvent, no isocyanates, and produce low smoke when castings are made.

ENABLING DISCLOSURE AND BEST MODE

The furan resins used in the no-bake binders are preferably low nitrogen furan resins. The furan resins are conventional furan resins prepared by the homopolymerization of furfuryl alcohol (hereafter a conventional furan resin), or preferably furans prepared by the homopolymerization of bis-hydroxymethylfuran (hereafter a bis-hydroxymethylfuran resin), and mixtures of these resins. These resins are prepared by the homopolymerization of the monomer in the presence of heat, according to methods well-known in the art. The reaction temperature used in making the furan resins typically ranges from 95° C. to 105° C. The reaction is continued until the percentage of free formaldehyde is less than 5 weight percent, typically from 3 to 5 weight percent, and the refractive index is typically from 1.400 to about 1.500. The viscosity of the resin is preferably from about 200 cps to 450 cps. The furan resins have an average degree of polymerization of 2 to 3.

Although not necessarily preferred, modified furan resins can also be used in the binder. Modified furan resins are typically made from furfuryl alcohol, urea formaldehyde, and formaldehyde at elevated temperatures under slightly alkaline conditions at a pH of from 7.0 to 8.0, preferably 7.0 to 7.2. The weight percent of furfuryl alcohol used in making the low nitrogen modified furan resins ranges from 60 to 75 percent; the weight percent of the urea formaldehyde used in making the low nitrogen modified furan resins ranges from 10 to 25 percent; and the weight percent of the formaldehyde used in making the low nitrogen modified furan resins ranges from 1 to 10 percent, where all weight percents are based upon the total weight of the components used to make the modified furan resin.

Although not necessarily preferred, urea-formaldehyde resins, phenol-formaldehyde resins, novolac resins, and phenolic resole resins may also be used in addition to the furan resin.

The furan resin is diluted with furfuryl alcohol to reduce the viscosity of the reactive furan resin.

Preferably, an activator is used in the binder. The activator promotes the polymerization of furfuryl alcohol and is selected from the group consisting of resorcinol, resorcinol pitch, and bisphenol A tar. Preferably used as the activator is resorcinol. Resorcinol pitch is defined as the highly viscous product, which remains on the bottom of the reaction vessel after resorcinol is produced and distilled from the reaction vessel. Resorcinol pitch is a solid at room temperature and has a melting point of about 70° C. to 80° C. Resorcinol pitch is mostly dimers, trimers, and polymeric resorcinol. It may also contain substituted materials. Bisphenol A tar is defined as the highly viscous product, which remains on the bottom of the reaction vessel after bisphenol A is produced and distilled from the reaction vessel. The bisphenol A tar is a solid at room temperature and has a melting point of about 70° C. to 80° C. Bisphenol A tar is mostly dimers, trimers, and polymeric bis phenol A. It may also contain substituted materials.

Preferably, the binder contains a bisphenol compound. The bisphenol compound used is bisphenol A, B, F, G, and H, but preferably is bisphenol A.

Preferably, the binder contains a polyol. The polyol is selected from the group consisting of polyester polyols, polyether polyols, and mixtures thereof. Aliphatic polyester polyols can be used in the binder. Aliphatic polyester polyols are well known and are prepared by reacting a dicarboxylic acid or anhydride with a glycol. They generally have an average hydroxyl functionality of at least 1.5. Preferably, the average molecular weight of the polyester polyol is from 300 to 800. Typical dicarboxylic acids preferably used to prepare the polyester polyols are adipic acid, oxalic acid, and isophthalic acid. The glycols typically used to prepare the polyester polyols are ethylene glycol, diethylene glycol and propylene glycol.

The polyether polyols that are used are liquid polyether polyols or blends of liquid polyether polyols having a hydroxyl number of from about 200 to about 600, preferably about 300 to about 500 milligrams of KOH based upon one gram of polyether polyol. The viscosity of the polyether polyol is from 100 to 1,000 centipoise, preferably from 200 to 700 centipoise, most preferably 300 to 500 centipoise. The polyether polyols may have primary and/or secondary hydroxyl groups.

These polyether polyols are commercially available and their method of preparation and determining their hydroxyl value is well known. The polyether polyols are prepared by reacting an alkylene oxide with a polyhydric alcohol in the presence of an appropriate catalyst such as sodium methoxide according to methods well known in the art. Any suitable alkylene oxide or mixtures of alkylene oxides may be reacted with the polyhydric alcohol to prepare the polyether polyols. The alkylene oxides used to prepare the polyether polyols typically have from two to six carbon atoms. Representative examples include ethylene oxide, propylene oxide, butylene oxide, amylene oxide, styrene oxide, or mixtures thereof. The polyhydric alcohols typically used to prepare the polyether polyols generally have a functionality greater than 2.0, preferably from 2.5 to 5.0, most preferably from 2.5 to 4.5. Examples include ethylene glycol, diethylene glycol, propylene glycol, trimethylol propane, and glycerine.

Although aliphatic polyester polyols and polyether polyols can be used in the binder, preferably the polyol used in the polyol component are liquid aromatic polyester polyols, or a blend of liquid aromatic polyester polyols, generally having a hydroxyl number from about 500 to 2,000, preferably from 700 to 1200, and most preferably from 250 to 600; a functionality equal to or greater than 2.0, preferably from 2 to 4; and a viscosity of 500 to 50,000 centipoise at 25° C., preferably 1,000 to 35,000, and most preferably 2,000 to 25,000 centipoise. They are typically prepared by the ester interchange of an aromatic ester and a polyol in the presence of an acidic catalyst. Examples of aromatic esters used to prepare the aromatic polyesters include phthalic anhydride and polyethylene terephthalate. Examples of polyols used to prepare the aromatic polyesters are ethylene glycol, diethylene glycol, triethylene glycol, 1,3, propane diol, 1,4 butane diol, dipropylene glycol, tripropylene glycol, tetraethylene glycol, glycerin, and mixtures thereof. Examples of commercial available aromatic polyester polyols are STEPANPOL polyols manufactured by Stepan Company, TERATE and Phenrez 178 polyol manufactured by Hoechst-Celanese, THANOL aromatic polyol manufactured by Eastman Chemical, and TEROL polyols manufactured by Oxide Inc.

It is highly preferred to include a silane in binder. Silanes that can be used can be represented by the following structural formula:

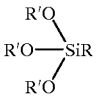

wherein R'is a hydrocarbon radical and preferably an alkyl radical of 1 to 6 carbon atoms and R is an alkyl radical, an alkoxy-substituted alkyl radical, or an alkyl-amine-substituted alkyl radical in which the alkyl groups have from 1 to 6 carbon atoms. Examples of some commercially available silanes are Dow Corning Z6040; Union Carbide A-1100 (gamma aminopropyltriethoxy silane); Union Carbide A-1120 (N-beta(aminoethyl)-gamma-aminopropyltrimethoxy silane); and Union Carbide A-1160 (ureido-silane).

The components are used in the following amounts: (a) from about 1 to about 50 parts by weight a reactive furan resin, preferably about 2 to 30 parts, most preferably from 6 to 22 parts (b) from about 10 to about 80 parts by weight furfuryl alcohol, preferably about 20 to 75, most preferably from 22 to 70, (c) from about 0.1 to about 20 parts by weight resorcinol, preferably from about 0.5 to 10, most preferably from 0.6 to 8 (d) from about 1 to about 30 parts by weight a bisphenol, preferably from about 2 to 15, most preferably from 3 to 12 (e) from about 0.1 to about 30 parts of a polyester polyol, preferably from about 2 to 20, most preferably from 3 to 15, (f) from about 0.01 to about 10 parts by weight a silane, preferably about 0.05 to about 5, most preferably from 0.07 to 3.

The catalyst component of the furan binder is critical to the effective practice of this invention. The catalyst comprises a Lewis acid. Examples of Lewis acids include halides of transition metals such as copper chloride, zinc chloride, and ferric chloride. Preferably used as the Lewis acid catalyst is zinc chloride. The Lewis acid catalyst is typically used in conjunction with another furan curing catalyst. Other furan curing catalysts include inorganic or organic acids, preferably organic acids. Preferably, the curing catalyst is a strong acid such as toluene sulfonic acid, xylene sulfonic acid, benzene sulfonic acid, HCl, and $H_2SO_4$. Weak acids such as phosphoric acid can also be used. Preferably, a mixture of toluene sulfonic acid/benzene sulfonic acid is used. Where necessary, water is used to compatibilize the Lewis acid with other acid components. The amount of curing catalyst used is an amount effective to result in foundry shapes that can be handled without breaking. Generally, this amount is from 1 to 45 weight percent active catalyst based upon the weight of total binder, typically from 10 to 40, preferably 15 to 35 weight percent. The weight ratio of Lewis acid in the curing catalyst to other furan curing catalyst ranges from about 1:20 to about 20:1 by weight based upon the total weight of the active catalyst, preferably about 1:10 to about 10:1, most preferably from 1:8 to about 8:1.

It will be apparent to those skilled in the art that other additives such as release agents, solvents, benchlife extenders, silicone compounds, etc. can be used and may be added to the binder composition, aggregate, or foundry mix.

The aggregate used to prepare the foundry mixes is that typically used in the foundry industry for such purposes or any aggregate that will work for such purposes. Generally, the aggregate is sand, which contains at least 70 percent by weight silica. Other suitable aggregate materials include zircon, alumina-silicate sand, chromite sand, and the like. Generally, the particle size of the aggregate is such that at least 80 percent by weight of the aggregate has an average particle size between 40 and 150 mesh (Tyler Screen Mesh).

The amount of binder used is an amount that is effective in producing a foundry shape that can be handled or is self-supporting after curing. In ordinary sand type foundry applications, the amount of binder is generally no greater than about 10% by weight and frequently within the range of about 0.5% to about 7% by weight based upon the weight of the aggregate. Most often, the binder content for ordinary sand foundry shapes ranges from about 0.6% to about 5% by weight based upon the weight of the aggregate in ordinary sand-type foundry shapes.

Although it is possible to mix the components of the binder with the aggregate in various sequences, it is preferred to add the curing acid catalyst to the aggregate and mix it with the aggregate before adding the binder.

Generally, curing is accomplished by filling the foundry mix into a pattern (e.g. a mold or a core box) to produce a workable foundry shape. A workable foundry shape is one that can be handled without breaking.

Metal castings can be prepared from the workable foundry shapes by methods well known in the art. Molten ferrous or non-ferrous metals are poured into or around the workable shape. The metal is allowed to cool and solidify, and then the casting is removed from the foundry shape.

Abbreviations

The following abbreviations are used in the Examples:

| | |
|---|---|
| Bis A | bisphenol A |
| bob | based on binder |
| bos | based on sand |
| FA | furfuryl alcohol |
| FURAN A | furan resin having an average degree of polymerization of about 2 to 3, prepared by the homopolymerization of furfuryl alcohol under slightly basic conditions at a reflux temperature of about 100° C. |
| FURAN B | furan resin having an average degree of polymerization of about 2 to 3, prepared by the homopolymerization of bis-hydroxymethylfuran under acidic conditions at a reflux temperature of about 100° C. |
| pbw | parts by weight based upon total parts |
| PP | a polyester polyol prepared by reacting dimethyl terephthalate (DMT) with diethylene glycol, such that the average molecular weight of the polyester polyol is about 600 |
| RES | resorcinol |
| RH | relative humidity |
| SIL | silane |
| ST | strip time is the time interval between when the shaping of the mix in the pattern is completed and the time and when the shaped mixture can no longer be effectively removed from the pattern, and is determined by the Green Hardness tester |
| TSA/BSA | 50:50 blend of toluene sulfonic acid/benzene sulfonic acid (50:50), a conventional furan curing catalyst in a solution that contains 32 weight percent water |
| WT | work time is the time interval between when mixing begins and when the mixture can no longer be effectively shaped to fill the mold or core and is determined by the Green Hardness tester |
| ZC/SA | 80:20 blend of zinc chloride/sulfonic acid, a Lewis acid furan catalyst within the scope of this invention, where the zinc chloride is 100% solid and the sulfonic acid is in a solution that contains 32 weight percent water |

EXAMPLES

The examples will illustrate specific embodiments of the invention. These examples, along with the written description, will enable one skilled in the art to practice the invention. It is contemplated that many other embodiments of the invention will be operable besides these specifically disclosed.

The foundry binders are used to make foundry cores by the no-bake process using a liquid curing catalyst to cure the furan binder. Examples within the scope of this invention use a 80:20 blend of ZC/SA. The Comparison Examples use a 50:50 blend of TSA/BSA as the curing catalyst. All parts are by weight and all temperatures are in °C. unless otherwise specified.

Foundry mixes were prepared by mixing Wedron 540 sand and catalyst for 2 minutes. Then the binders described in the tables were added and mixed for 2 minutes. The foundry mixes tested had sufficient flowability and produced workable foundry shapes under the test conditions.

The resulting foundry mixes were used to fill core boxes to make dogbone testing samples. Test shapes (dogbone shapes) were prepared to evaluate the sand tensile development and the effectiveness of the test shapes in making iron castings. Testing the tensile strength of the dogbone shapes enables one to predict how the mixture of sand and binder will work in actual foundry facilities. The dogbone shapes were stored at 1 hr, 3 hrs, and 24 hrs in a constant temperature room at relative humidity of 50% and a temperature of 25 C. before measuring their tensile strengths. Unless otherwise specified, the tensile strengths were also measured for the dogbone shapes after storing them 24 hrs at a relative humidity (RH) of 90%. Test castings of grey iron, and in some cases, steel, were made with the test cores to predict how the cores would perform when used in commercial casting operations.

Example 1 and Comparison A

Comparison of Furan Binder Cured with ZC/SA and TSA/BSA

This example compares test castings made with test cores prepared with Binder A as described below. In one case, the cores were cured ZC/SA (within the scope of this invention) and in the other case, the test cores were cured with TSA/BSA (comparative catalyst). The formulation of Binder A is set forth in Table I.

TABLE I

| (Example 1 and Comparison A) Binder A | |
|---|---|
| Component | Amount (pbw) |
| FA | 52.85- |
| RES | 2.71 |
| SIL | 0.10 |
| BIS A | 7.91 |
| PP | 4.44 |
| FURAN A | 11.99 |
| Furan B | 20.00 |

In Example 1, one weight percent binder (bos) was mixed with 27 weight percent ZC/SA catalyst (bob). In Comparison A, the binder was mixed with 26% TSA/BSA catalyst (bob). Binder A is used in both Example 1 and Comparison A.

Cylindrical castings (2"×2"×2") were made by pouring molten grey iron through sand cores made using the curing catalyst of Example 1 and Comparison A. The pouring temperature of the grey iron was 2700° C. The penetration tests for veining and mechanical penetration are described by Tordoff and Tenaglia in AFS Transactions, pp.149–158 (AFS 84th Annual meeting, St. Louis, Mo., Apr. 21–25, 1980). Surface defects were determined by visual observation and rating the casting based upon experience. The results are summarized in Table II.

TABLE II

| Grey Iron Casting Results | | |
|---|---|---|
| CATALYST | PENETRATION RESISTANCE | VEINING RESISTANCE |
| TSA/BSA (comparative catalyst) | 4.5 | 4.5 |
| ZC/SA (catalyst of Example 1) | 1.5 | 2.5 |

Casting grade: 1=Excellent, 2=Good, 3=Fair, 4=Poor, 5=Very Poor.

The data in Table II indicate that test cores cured with the ZC/SA catalyst showed increased resistance to veining and penetration during the casting process when grey iron was casted. Less veining reduces tooling time, cleaning time, waste, and results in increased the productivity in the foundry operation. The erosion resistance and surface appearance of the casting prepared with the test core cured with the comparative catalyst were similar to that of the casting prepared with the test core that was cured with the catalyst of Example 1.

Example 2 and Comparison B

Comparison of More Generic Furan Binder Cured with ZC/SA and TSA/BSA

This example illustrates the preparation of test cores from a more generic furan binder that is cured with the ZC/SA catalyst and TSA/BSA catalyst, and the use of these test cores to cast grey iron. In Example 2, one percent by weight of binder (bos) and 27 weight percent of the ZC/SA catalyst (bob) were mixed with Wedron 540 sand. In Comparison B, 26 weight percent of the TSA/BSA blend (bob) was used instead of the ZC/SA catalyst. The binder used in both cases, Binder B, is described in Table III below.

TABLE III

| (Formulation for Binder B) | |
|---|---|
| FA | 73.57 |
| PP | 16.20 |
| FURAN A | 10.00 |
| SIL | 0.23 |
| Total | 100.00 |

Grey iron castings were prepared in accordance with the procedure set forth in Example 1. Penetration, veining, and surface finish were evaluated as set forth in Example 1. The results are set forth in Table IV.

TABLE IV

| Grey Iron Casting Results | | |
|---|---|---|
| CATALYST | PENETRATION RESISTANCE | VEINING RESISTANCE |
| TSA/BSA (comparative catalyst) | 4.0 | 4.0 |
| ZC/SA (catalyst of Example 1) | 2.0 | 3.0 |

The data in Table IV indicate that test cores cured with the ZC/SA catalyst show increased resistance to veining and penetration during the casting process using grey iron. Less veining reduces tooling time, cleaning time, waste, and results in increased the productivity in the foundry operation. The erosion resistance and surface appearance of the casting prepared with the test core cured with the comparative catalyst were similar to that of the casting prepared with the test core that was cured with the catalyst of Example 2.

Examples 3 and 4

Furan Binders without Bisphenol A and Resorcinol

Test cores were made using 1.2 weight percent (bos) of a binder according to the procedure of Example 1. The formulations of the binders used are set for in Table V that follows. The binder of Example 3 is similar to the binder of Example 1 (Binder A) except it does not contain bisphenol A or resorcinol. The foundry mixes used to prepare the test cores both contained 30 weight percent ZC/SA bob as the curing catalyst. The tensile strengths of the test cores were measured and are set forth in Table V.

TABLE V

| (Furan binders with and without bisphenol A aud resorcinol) Binder Formulations | | |
|---|---|---|
| | Example 3 | Example 4 |
| FA | 73.57 | 52.85 |
| PP | 16.20 | 4.44 |
| FURAN | 10.00 | 11.99 |
| SIL | 0.23 | 0.10 |
| Bis A | — | 7.91 |
| RES | — | 2.71 |
| BHF | | 20.0 |
| Total | 100.0 | 100.00 |

TABLE VI (Tensile Strengths of Test Cores)

| | Example 3 | Example 4 |
|---|---|---|
| WT/ST (minutes) | 13.5/21.3 | 4.5/6.8 |
| Tensile Strength (psi) | | |
| 15 minutes | 23 | 36 |
| 30 minutes | 40 | 91 |
| 1 hour | 98 | 129 |
| 24 hour (psi) | 335 | 160 |

The data in Table VI indicate that, in addition to using the ZC/SA curing catalyst, it is advantageous to use resorcinol and bisphenol A in the binder.

Example 5 and Comparison C

Comparison of Tensile Strengths of Test Cores Prepared with a Furan Binder and with a Phenolic-urethane Binder Example 5 compares tensile strengths of cores made with the furan binder of Example 3, but using 25 weight percent 80:20 ZC/TSA (bob) as the curing catalyst, to a phenolic-urethane binder that uses a liquid tertiary amine as the curing catalyst. The phenolic-urethane binder is a high-speed commercially available and successfull phenolic-urethane binder system sold as PEPSET® 2105/2210/3501 system by Ashland Inc. The test conditions for the phenolic-urethane binder are set forth below. The test results are summarized in Table VII.

Test Conditions

Binder: 1.0% based on the sand weight

PEPSET® binder:

Part I (phenolic resin component)/II (isocyanate component)=62/38

Catalyst: 3% liquid tertiary amine based on the Part I

TABLE VII (Tensile Strengths of Test Cores)

| | Example 5 (Binder of Example 3) | Comparison C (PEPSET ® binder) |
|---|---|---|
| WT/ST (minutes) | 3.8/6.0 | 5.0/6.3 |
| Tensile strength | | |
| 1 hour (psi) | 170 | 162 |
| 3 hours (psi) | 195 | 167 |
| 24 hours (psi) | 183 | 259 |
| 24 hrs @ 90% RH | 73 | 60 |

The data in Table VII indicate that the binder of Example 3 using the ZC/SA curing catalyst has a cure speed comparable to the phenolic-urethane binder. Moreover, the test cores made with the binder have comparable tensile strengths and their resistance to humidity is much better than the cores prepared with the phenolic-urethane binder.

Example 6

Casting Comparison Using Grey Iron

Grey iron test castings were made according to the procedure of Example 1 using the binder of Example 3 and the PEP SETS® binder described previously. The test conditions were as described in Example 5 and the pouring temperature of the grey iron was 2700° C. The casting performance is described in Table VIII that follows.

TABLE VIII

Grey Iron Casting Results

| BINDER | PENETRATION RESISTANCE | VEINING RESISTANCE |
|---|---|---|
| PEP SET | 1.5 | 3.5 |
| Example 6 | 1.0 | 1.0 |

The data in Table VIII indicate that test cores made from a furan binder cured with the ZC/SA catalyst showed improved resistance to veining for grey iron castings when compared to phenolic-urethane system. Less veining reduces tooling time, cleaning time, waste, and results in increased the productivity in the foundry operation.

Example 7 and Comparison D

Casting Comparison Using Steel

Steel test castings were made according to the procedure of Example 1 using the binder of Example 3 and the PEP SET® binder described previously. The test conditions were as described in Example 6, and the pouring temperature of the steel was 2950° C. The casting performance is described in Table IX that follows.

TABLE IX

Steel Casting Results

| BINDER | PENETRATION RESISTANCE | VEINING RESISTANCE |
|---|---|---|
| PEP SET | 1.0 | 5.0 |
| Example 6 | 1.0 | 1.0 |

The data in Table IX indicate that test cores made from a furan binder cured with the ZC/SA catalyst showed improved resistance to veining for steel castings when compared to phenolic-urethane system. Less veining reduces tooling time, cleaning time, waste, and results in increased the productivity in the foundry operation.

We claim:

1. A furan no-bake binder, which cures in without heating, comprising:

(a) a reactive furan resin, (b) furfuryl alcohol, (c) an activator selected from the group consisting of resorcinol, resorcinol pitch, and bisphenol A tar, (d) a bisphenol compound, (e) a polyol, and (f) a catalyst component comprising a catalytically effective amount of a halide of a transition metal.

2. The binder of claim 1 wherein the catalyst component also includes a conventional furan catalyst.

3. The binder of claim 2 wherein the weight ratio of active halide of a transition metal of the catalyst component to conventional furan catalyst is from about 1.0:10 to about 10:1.

4. The binder of claim 3 wherein the reactive furan resin is a mixture of a conventional furan resin and bis-hydroxymethylfuran resin.

5. The binder of claim 4 that further comprises an activator selected from the group consisting of resorcinol, resorcinol pitch, and bisphenol A tar.

6. The binder of claim 5 that further comprises a bisphenol compound.

7. The binder of claim 6 that also contains a silane.

8. The binder of claim 7 wherein the binder comprises: (a) from about 1 to about 50 parts by weight a reactive furan resin, (b) from about 10 to about 80 parts by weight furfuryl alcohol, (c) from about 0.1 to about 20 parts by weight resorcinol, (d) from about 1 to about 30 parts by weight a bisphenol, (e) from about 0.1 to about 30 parts of a polyol, and (f) from about 0.01 to about 10 parts by weight a silane, wherein said parts of the binder components are by weight are based upon 100 parts the weight of the binder.

9. The binder of claim 8 wherein the weight ratio of conventional furan resin to bis-hydroxymethylfuran resin is from about 1:20 to about 20:1.

10. The binder of claim 9 wherein the polyol is an aromatic polyester polyol polyester polyol has a hydroxyl number of about 700 to 1200.

11. The binder of claim 10 wherein the polyester polyol is the reaction product of an aromatic polyester selected from the group consisting of phthalic anhydride and polyethylene terephthalate and a glycol selected from the group consisting of ethylene glycol and diethylene glycol.

12. The binder of claim 11 wherein the activator is resorcinol.

13. The binder of claim 12 wherein the bisphenol compound is bisphenol A.

14. The binder of claim 13 wherein the binder comprises: (a) from about 2 to about 30 parts by weight a reactive furan resin, (b) from about 20 to about 75 parts by weight furfuryl alcohol, (c) from about 0.5 to about 10 parts by weight resorcinol, (d) from about 2 to about 15 parts by weight a bisphenol, (e) from about 2 to about 20 parts of a polyester polyol, and (f) from about 0.05 to about 5 parts by weight a silane, wherein said parts of the binder components are by weight are based upon 100 parts the weight of the binder.

15. The binder of claim 14 wherein the weight ratio of Lewis acid catalyst to conventional furan catalyst is from about 1:8 to about 8:1.

16. The binder of claim 15 wherein the Lewis acid catalyst is zinc chloride.

17. The binder of claim 16 wherein the conventional furan catalyst is selected from the group consisting of sulfonic acid, toluene sulfonic acid, benzene sulfonic acid, and mixtures thereof.

18. A foundry mix comprising:

A. a major amount of foundry aggregate; and

B. an effective binding amount of a foundry binder of claim 1, 2, 3, 4, 5, 6, 7, 8, 9, 11, 12, 13, 14, 15, or 16.

19. A process for preparing a foundry shape comprising:

A. shaping the foundry mix of claim 18 into a foundry shape;

B. allowing the foundry shape to harden into a workable foundry shape.

20. A foundry shape prepared in accordance with claim 19.

21. A method for preparing a metal casting comprising:

A. fabricating a shape in accordance with claim 19;

B. pouring said metal while in the liquid state into and around said shape;

C. allowing said metal to cool and solidify; and

D. then separating the molded article.

22. A metal casting prepared in accordance with claim 21.

* * * * *